US011621505B2

(12) United States Patent
Attarzadeh et al.

(10) Patent No.: US 11,621,505 B2
(45) Date of Patent: Apr. 4, 2023

(54) CABLE LUG, CONTACT ELEMENT AND METHOD FOR PRODUCING SAID ELEMENT

(71) Applicant: Auto-Kabel Management GmbH, Hausen i.W. (DE)

(72) Inventors: Amir Hossein Attarzadeh, Mönchengladbach (DE); Wera Skele, Viersen (DE)

(73) Assignee: Auto-Kabel Management GmbH, Hausen i.W. (DE)

( * ) Notice: Subject to any disclaimer, the term of this patent is extended or adjusted under 35 U.S.C. 154(b) by 206 days.

(21) Appl. No.: 17/286,040

(22) PCT Filed: Nov. 6, 2019

(86) PCT No.: PCT/EP2019/080313

§ 371 (c)(1),
(2) Date: Apr. 16, 2021

(87) PCT Pub. No.: WO2020/094678

PCT Pub. Date: May 14, 2020

(65) Prior Publication Data

US 2021/0384651 A1 Dec. 9, 2021

(30) Foreign Application Priority Data

Nov. 8, 2018 (DE) ..... 10 2018 127 900.0

(51) Int. Cl.
*H01R 11/12* (2006.01)
*H01R 4/70* (2006.01)
(Continued)

(52) U.S. Cl.
CPC ..... *H01R 11/12* (2013.01); *H01R 4/70* (2013.01); *H01R 43/24* (2013.01); *H01R 4/30* (2013.01)

(58) Field of Classification Search
CPC ..... H01R 11/12; H01R 4/70; H01R 43/24; H01R 4/30; H01R 13/5213;
(Continued)

(56) References Cited

U.S. PATENT DOCUMENTS 4,199,214 A * 4/1980 Pearce, Jr. ..... H01R 11/12 439/620.26
5,346,408 A * 9/1994 Chupak ..... H01R 11/284 439/522
(Continued)

FOREIGN PATENT DOCUMENTS

CN 107342468 A 11/2017
DE 20 2006 013 652 U1 11/2006
(Continued)

OTHER PUBLICATIONS

International Searching Authority/EP, International Search Report and Written Opinion of the International Searching Authority, Application No. PCT/EP2019/080313, dated Feb. 3, 2020, 17 pages, (*with English translation of the search report*).
(Continued)

*Primary Examiner* — Truc T Nguyen
(74) *Attorney, Agent, or Firm* — Sunstein LLP

(57) ABSTRACT

The invention relates to a cable lug (10, 10', 10'', 10''') having a connection region (9, 9'', 9''') for connecting the cable lug (10, 10', 10'', 10''') to an electrical conductor (4) and having a contact part (11) for establishing contact with a terminal part (40) of an electrical system (42), in particular of an electrical system of a motor vehicle, the contact part (11) comprising a fastening opening (12) for guiding therethrough a fastening element (46) for fastening the cable lug (10, 10', 10'', 10''') to a terminal part (4), and wherein the contact part (11) comprises one or more further openings (13). The invention further relates to the use of the cable lug (10, 10', 10'', 10'''), a contact element (2) with such a cable
(Continued)

log (10, 10', 10'', 10''') as well as to a method for producing the same.

7 Claims, 10 Drawing Sheets

(51) Int. Cl.
*H01R 43/24* (2006.01)
*H01R 4/30* (2006.01)

(58) Field of Classification Search
CPC ..... H01R 13/5216; H01R 13/5219; H01R 13/405; H01R 13/504
See application file for complete search history.

(56) References Cited

U.S. PATENT DOCUMENTS

| | | | | |
|---|---|---|---|---|
| 5,588,883 | A * | 12/1996 | Hattori | H01R 11/282 439/761 |
| 5,906,495 | A | 5/1999 | Morgan | |
| 6,225,000 | B1 | 5/2001 | Pavlik et al. | |
| 6,250,973 | B1 * | 6/2001 | Lowery | H01R 11/281 439/763 |
| 6,428,364 | B2 | 8/2002 | Saito et al. | |
| 6,902,434 | B2 * | 6/2005 | Stack | H01M 50/552 439/620.28 |
| 7,192,319 | B1 * | 3/2007 | Rahman | H01R 11/12 439/766 |
| 2006/0079138 | A1 * | 4/2006 | Zhao | H01R 11/12 439/883 |
| 2007/0207652 | A1 | 9/2007 | Tsuruta | |
| 2010/0075535 | A1 | 3/2010 | Mizutani et al. | |
| 2013/0189860 | A1 | 7/2013 | Pyron | |
| 2016/0043500 | A1 | 2/2016 | Mori et al. | |
| 2016/0294107 | A1 | 10/2016 | Trimborn | |
| 2017/0279216 | A1 | 9/2017 | Thurn | |
| 2018/0294605 | A1 | 10/2018 | Iizuka et al. | |

FOREIGN PATENT DOCUMENTS

| | | | |
|---|---|---|---|
| DE | 10 2014 216762 | A1 | 2/2016 |
| DE | 10 2016 100 978 | A1 | 10/2016 |
| DE | 10 2016 100978 | A1 | 10/2016 |
| EP | 1 054 461 | A2 | 11/2000 |
| EP | 1 439 614 | A1 | 7/2004 |
| JP | H0594960 | U | 12/1993 |
| JP | H11167911 | A | 6/1999 |
| JP | 2001023720 | A | 1/2001 |
| JP | 2003-217703 | A | 7/2003 |
| WO | WO 2008/025159 | A1 | 3/2008 |
| WO | WO 2014/132907 | A1 | 9/2014 |

OTHER PUBLICATIONS

International Preliminary Examining Authority/EP, Written Opinion of the International Preliminary Examining Authority, Application No. PCT/EP2019/080313, dated Oct. 9, 2020, 8 pages, (*in German*).
German Patent Office, Office Action, Application No. 10 2018 127 900.0, dated Jul. 1, 2019, 6 pages (*in German*).
Cohauz & Florack, U.S. Appl. No. 17/285,821 and preliminary amendment filed Apr. 15, 2021, 37 pages.

* cited by examiner

CABLE LUG, CONTACT ELEMENT AND METHOD FOR PRODUCING SAID ELEMENT

CROSS-REFERENCE TO RELATED APPLICATIONS

This application is the national phase entry of international patent application no. PCT/EP2019/080313 filed Nov. 6, 2019 and claims the benefit of German patent application No. 10 2018 127 900.0, filed Nov. 8, 2018, the disclosures of which are incorporated herein by reference in their entirety.

TECHNICAL FIELD

The invention relates to a cable lug having a connection region for connecting the cable lug to an electrical conductor and having a contact part for establishing contact with a terminal part of an electrical system, in particular of an electrical system of a motor vehicle, the contact part comprising a fastening opening for guiding therethrough a fastening element, for example a screw or a threaded bolt, for fastening the cable lug to a terminal part. The invention furthermore relates to a contact element having such a cable lug and to a method for producing such a contact element.

BACKGROUND ART

Various types of cable lugs are known from the prior art, with which cable lugs a cable can be attached to a terminal part of an electrical system. To this end, the cable lug is typically connected to one end of a cable, in particular by welding, soldering or crimping in the connection region of the cable lug. Subsequently, the cable lug may be connected with its contact part to a terminal part, for example by a threaded bolt of the terminal part being guided through the fastening opening and secured with a nut, or by a screw being guided through the fastening opening and screwed into a threaded bore of the terminal part. In this way, a reliable low-ohmic connection may be produced between a cable and a terminal part of an electrical system.

In the event of moist or otherwise corrosive ambient conditions, such as prevail for example in a motor vehicle, particularly in its engine compartment, the cable lug is generally provided with a housing in order to protect the connection of the cable lug to the cable and to the terminal part of the electrical system against corrosion. Furthermore, such housings are used for safety reasons in order to prevent accidental contact with live parts.

Such a contact element, having a cable lug, a conductor attached thereto and a housing is known, for example, from DE 10 2013 021 409 A1.

The housing often consists of a plastic and may, for example, be produced by injection-moulding. Since high mechanical stresses may act on the cable lug when connecting the cable lug to a terminal part of an electrical system, in particular when tightening a nut or a screw, secure embedding of the cable lug in the housing is desirable so that the cable lug cannot be detached from the housing even under the effect of a force, and durable protection against penetrating moisture is ensured.

Against this background, the object of the present invention is to provide a cable lug, a contact element having such a cable lug and a method for producing such a contact element, which allow stable housing of the cable lug.

SUMMARY OF THE INVENTION

For a cable lug having a connection region for connecting the cable lug to an electrical conductor and having a contact part for establishing contact with a terminal part of an electrical system, in particular of an electrical system of a motor vehicle, the contact part comprising a fastening opening for guiding therethrough a fastening element for fastening the cable lug to a terminal part, this object is achieved according to the invention in that the contact part comprises one or more further openings.

The one or more further openings allow better connection of the cable lug to a housing overmoulded on the cable lug, by the material of the housing being injection-moulded through one or more of the one or more further openings during the overmoulding of the cable lug so that the material of the housing extends through the one or more further openings. In this way, the cable lug is embedded at the opening with a form fit into the overmoulded housing. On the other hand, a part of the contact part having the fastening opening, and therefore in particular the fastening opening itself, remains free during the overmoulding, in order to make it possible to connect the cable lug to a terminal part by guiding a fastening element through the fastening opening.

Correspondingly, the aforementioned object is furthermore achieved according to the invention by the use of the cable lug described above for producing a contact element in an injection-moulding method. During the injection-moulding method, in particular, injection-moulding is carried out through one or more of the one or more further openings, so that the contact part and therefore the cable lug can be embedded firmly into the overmoulded housing. Since the plastic does not form a material bond with the contact part, the form-fit connection by means of the openings is advantageous.

The aforementioned object is furthermore achieved according to the invention by a contact element for establishing electrical contact of an electrical conductor to a terminal part of an electrical system, in particular of an electrical system of a motor vehicle, having an electrical conductor and having the cable lug described above, which is conductively connected to the electrical conductor, wherein the cable lug is overmoulded with a housing in such manner that a part of the contact part having the fastening opening is exposed, and wherein it is injection-moulded at least through one of the one or more further openings of the cable lug.

The electrical conductor may in particular be a cable, preferably having strands, for example copper strands or aluminium strands.

The contact part of the cable lug is preferably configured to be flat, in order to facilitate the guiding-through of a fastening element and the production of a low-ohmic connection to a terminal part of an electrical system. The cable lug preferably comprises a flat annular contact part having a fastening opening in the form of a bore, in particular a central bore, and a plurality of smaller further openings arranged around the latter.

The fastening opening is in particular a central hole, for example a bore, in the contact part, through which a fastening element, in particular a screw or a threaded bolt, can be guided. The contact part may thus, in particular, be configured as a ring. As an alternative, the fastening opening may also be open to the edge of the contact part. The contact part may thus, in particular, be configured as a fork.

The one or more fastening openings are preferably fully enclosed by the material of the contact part on the edge side, i.e. they are arranged with a distance to the edge of the contact part. In this way, secure form-fit fixing of the cable lug in an overmoulding is achieved. The openings may for example be configured to be round, oval or elongate.

The connection region of the cable lug may in particular be provided for welding or soldering an electrical conductor on, and to this end may for example be configured to be planar. A metal contact layer may be applied in the connection region, in particular by friction coating, in order to improve the weld contact with an electrical conductor. Cable lugs having such a metal contact layer are known, for example, from DE 10 2014 011 887 A1. Furthermore, the connection region may also be configured for a crimp connection, the connection region to this end preferably comprising crimping tabs, which are bent around the strands of the cable when crimping to a cable.

Preferably, a connection region configured for a crimp connection is configured for crimping only onto the conductor strands, i.e. without insulation crimping. Since the cable lug is intended for overmoulding, insulation crimping, which is used to stabilise the crimp connection, may typically be dispensed with since the overmoulding ensures the required stability.

In the contact element, the cable lug and a section, attached thereto, of the electrical conductor are preferably overmoulded with an electrically insulating housing in such manner that a part of the contact part having the fastening opening is exposed. In this way, in particular, the connection region of the cable and the cable lug is overmoulded and thereby protected against moisture.

Furthermore, the aforementioned object is achieved according to the invention by a method for producing the contact element described above, wherein the cable lug described above is provided and wherein a housing is produced by overmoulding the cable lug, in which the fastening opening is exposed, and injection-moulding is carried out through at least one of the one or more further openings of the cable lug.

Various embodiments of the cable lug, of the contact element and of the method will be described below, the individual embodiments applying independently of one another respectively for the cable lug, the contact element and the method. Furthermore, the individual embodiments may be combined with one another.

In one embodiment, the one or more further openings are smaller than the fastening opening at least in one direction. In this way, the contact parts may be configured to be smaller and more compact, without the material absent because of the one or more further openings leading to weakening of the contact part.

In a further embodiment, the one or more further openings are arranged closer to the edge of the contact part than the fastening opening. In this way, injection-moulding may be carried out more easily through the one or more further openings when overmoulding the cable lug, while the fastening opening is left free.

In a further embodiment, the contact part comprises a plurality of further openings, which are arranged around the fastening opening. In this way, fixing of the contact part on several sides may be achieved when overmoulding, so that the contact part can absorb forces better in different directions.

In a further embodiment, the material of the housing is injection-moulded through at least one of the one or more further openings of the cable lug. In a corresponding embodiment of the method, the material of the housing is injection-moulded through at least one of the one or more further openings of the cable lug during the production of the housing. In this way, the housing is injection-moulded through directly during the injection-moulding process for producing the housing, in order to ensure secure anchoring of the cable lug in the housing. A separate injection-moulding process for injection-moulding through the at least one further opening can therefore be dispensed with. Furthermore, a material that is as hard as possible is typically used for the housing, so that particularly strong anchoring of the cable lug in the housing is made possible. The material of the housing is preferably a thermoplastic elastomer, in particular a thermoplastic polyurethane, more preferably having a hardness of at least Shore-D 60.

A Shore hardness is intended to mean the Shore hardness measured according to DIN 53505EN.

In a further embodiment, the contact element comprises an element injection-moulded onto the housing, and the material of the element injection-moulded on is injection-moulded through at least one of the one or more further openings of the cable lug. In an associated embodiment of the method, at least one of the one or more further openings of the cable lug remains free during the production of the housing, and an element connected to the housing is produced by injection-moulding onto the housing, the material of the element being injection-moulded through the at least one opening which remained free during the production of the housing. The injection-moulding through the openings may in this way also be achieved in a separate injection-moulding process, for example in a second injection-moulding step of a two-component injection-moulding process.

In particular, an element injection-moulded on, for example a sealing element, which is arranged on both sides of the contact part, may be produced easily in this way since the material of the element injection-moulded on may reach through at least one of the one or more openings from one side of the contact part to the other. This makes it possible to injection-mould such an element on even in the case of only one-sided injection-moulding of the material into an injection mould. In this way, the production method of a contact element may be simplified. In this case, for example, the housing may be injection-moulded on in a first step. In this step, the material of the housing may flow through one or more of the openings and set. In order to allow subsequent injection-moulding of the sealing element onto both sides of the contact part, one or more of the openings may be covered when overmoulding with the housing, so that the material of the housing cannot enter these covered openings. The covering may for example be ensured by the injection mould, in which for example a pin is inserted into the covering or a cover element covers the opening. In the subsequent step of injection-moulding the sealing element on, these one or more openings are free and the material of the sealing element can flow through the opening and therefore reach both sides of the contact part and set. Overmoulding of the housing and injection-moulding-on of the seal may therefore take place from only one side, and two separate injection-moulding processes are not necessary.

In a further embodiment, the housing comprises a channel which extends from an opening of the housing to the exposed part of the contact part, and the element injection-moulded on is a sealing element for sealing a closure, in particular a cover, usable for closing the hole. Preferably, the material of the element injection-moulded on is a thermoplastic elastomer, preferably having a lower hardness than the material of the housing in order to be able to achieve a better sealing effect.

Further advantages and features of the cable lug, of the contact element and of the method may be found in the following description of exemplary embodiments, reference being made to the appended drawing.

DETAILED DESCRIPTION OF SPECIFIC EMBODIMENTS

Figure 1A:
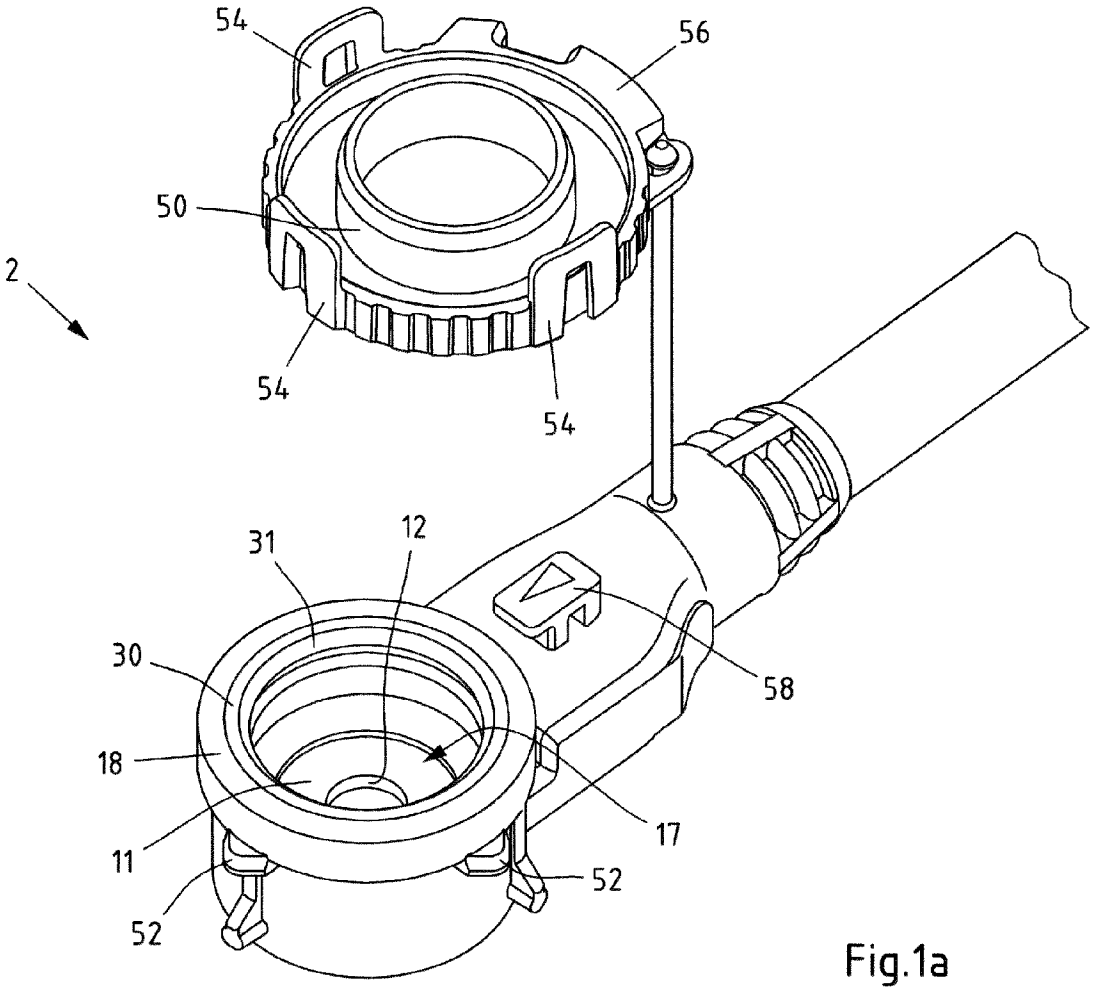
FIG. 1*a-b* show an exemplary embodiment of the cable lug and of the contact element.
Figure 1B:
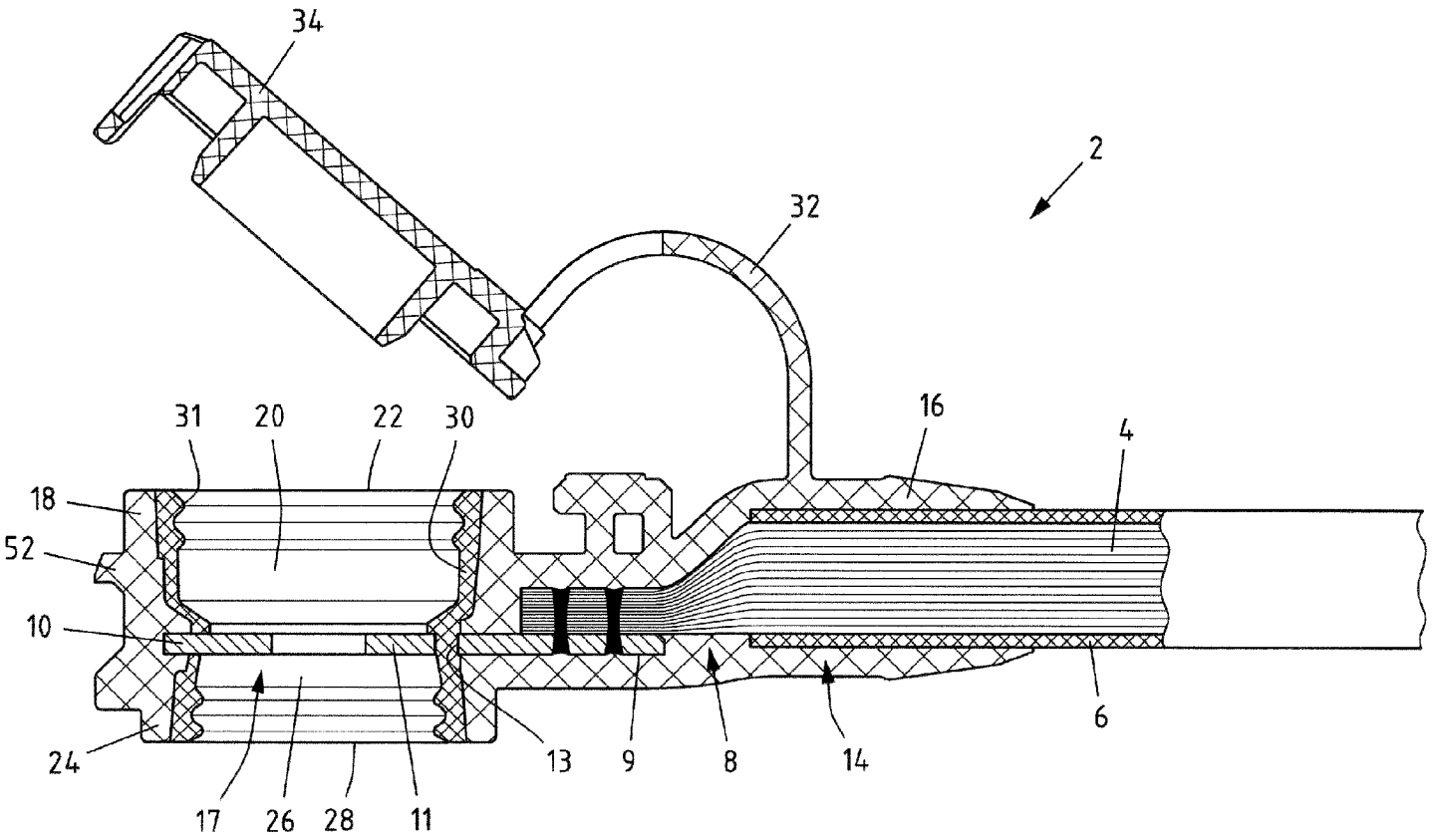

FIG. 1*a-b* show an exemplary embodiment of the cable lug 10 and an exemplary embodiment of a contact element 2 comprising the cable lug in isometric view (FIG. 1*a* and in sectional view (FIG. 1*b*).

The contact element 2 comprises an electrical conductor 4, which is sheathed with a conductor insulation 6 made of quite soft polyurethane, for example with the Shore-A hardness 80. One end 8 of the conductor 4 is stripped and is conductively connected by means of ultrasound welding to a connection region 9 of a cable lug 10. The cable lug 10 comprises a flat annular contact part 11 having a fastening opening in the form of a central bore 12 and a plurality of smaller further openings 13 arranged around the latter.

The cable lug 10 and a section 14, attached thereto, of the electrical conductor 8, are overmoulded with an electrically insulating housing 16 made of a polyurethane, a part 17 of the contact part 11 having the bore 12 being exposed. The overmoulding is carried out in such manner that the material of the housing 16 is injection-moulded through some of the further openings 13 of the contact part 11, so that the housing extends through these further openings 13. In this way, the contact part 11 and therefore the cable lug 10 are firmly anchored in the housing.

The housing 16 forms a first socket 18 having a first channel 20, which extends from a first opening 22 of the housing to the exposed part 17 of the contact part 11, and a second socket 24 having a second channel 26, which extends from a second opening 28 of the housing 16 to the exposed part 17 of the contact part 11.

In the first and second channels 20, 26, a sealing element 30 having annular sealing lips 32, which consists of a softer plastic than the housing 16, for example of thermoplastic polyethylene, is injection-moulded onto the housing 16. The material of the sealing element 30 is injection-moulded through some further openings of the plurality of openings 13 of the contact part 11. This allows a one-piece sealing element 30 on both sides of the contact part 11, i.e. here in the first and second channels 20, 26.

By means of a filamentary holding element 32, a cover 34 is connected inseparably to the housing 16. The cover 34 consists of a harder material than the housing, for example of polyamide, and is latched by means of a form-fit connection to the end of the filamentary holding element 32.

The shape of the cover 34 is matched to the shape of the first socket 18, so that the cover 34 can be placed onto the first socket 18 in order to close the opening 22.

Figure 2A:
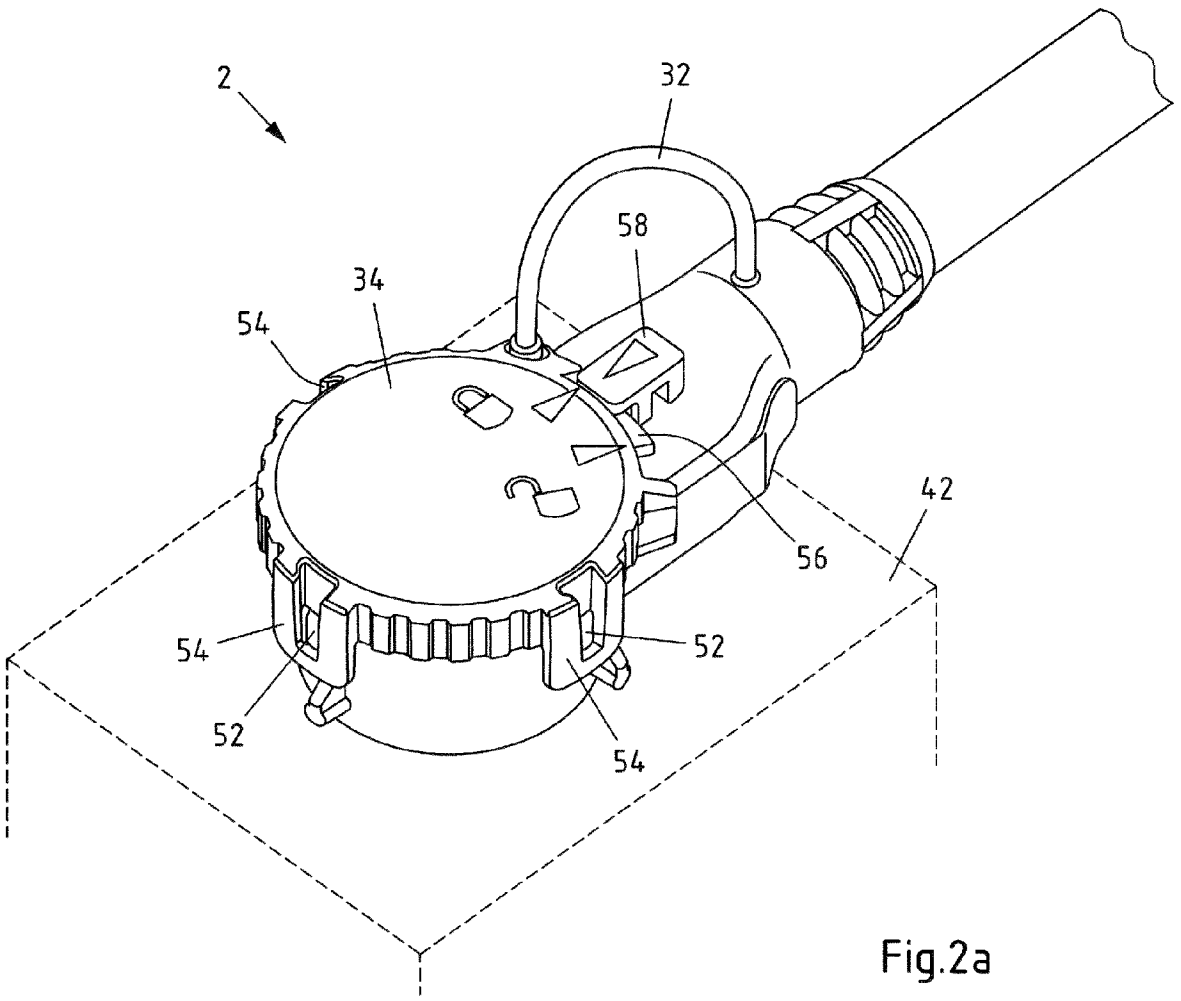
FIG. 2*a-b* show the contact element of FIG. 1*a-b* after producing an electrical contact with a terminal part of an electrical system.
Figure 2B:
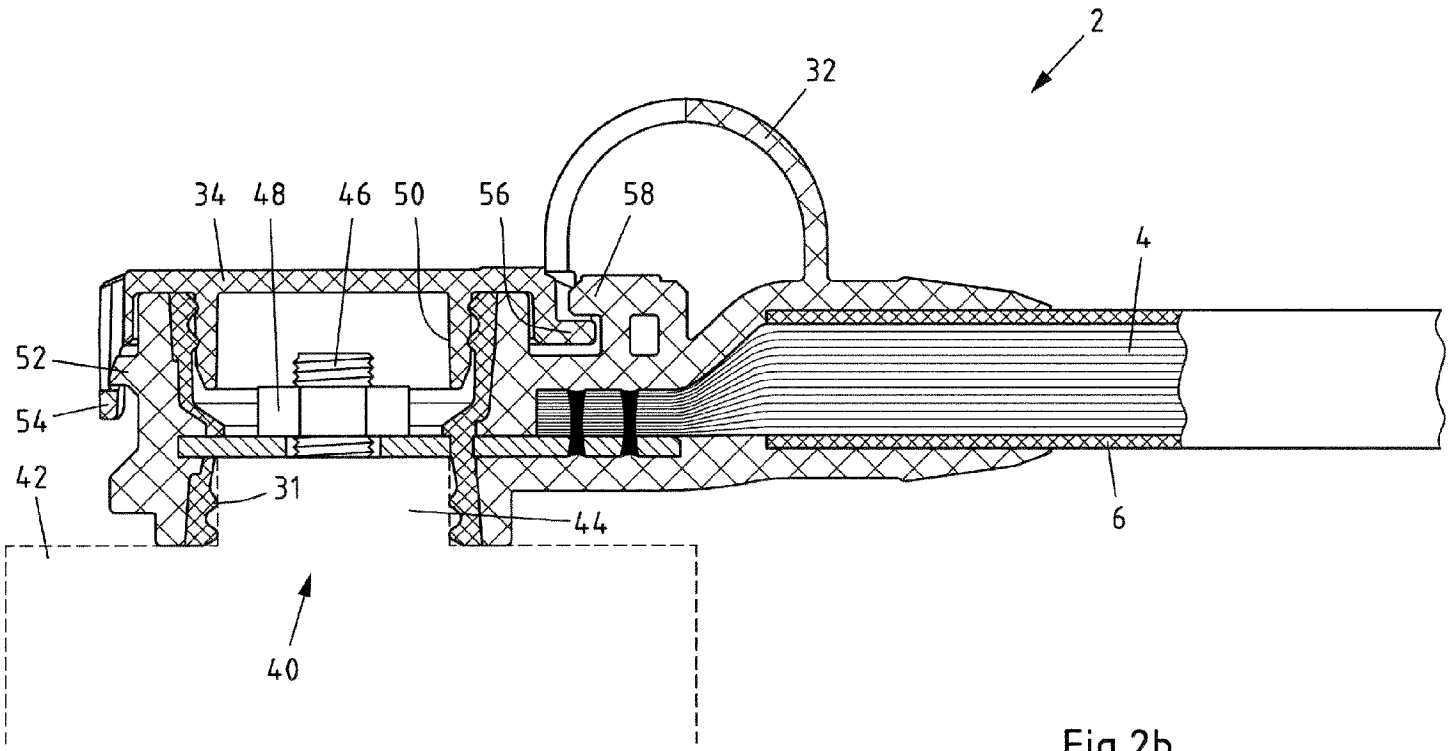

FIG. 2*a-b* show the contact element 2 of FIG. 1*a* after attachment to a terminal part 14 of an electrical system 42 of a motor vehicle, specifically in isometric view (FIG. 2*a*) and in sectional view (FIG. 2*b*). The terminal part 40 comprises a slightly conical electrically insulating base 44 having an electrically conductive threaded bolt 46 made of metal. During the attachment, the contact element 2 is fitted with the second channel 26 over the base 44 so that the threaded bolt 46 is guided through the bore 12 of the contact part 11 of the cable lug 10. Through the first channel 20, the threaded bolt may be secured with a nut 48.

By the further openings 13 of the contact part 11, through which the material of the housing 16 is injection-moulded, and their arrangement around the fastening opening 12, strong anchoring of the contact part in the housing 16 is achieved, so that the large forces possibly exerted when tightening the nut 48 cannot detach the contact part 11 from the housing 16.

The sealing element 30 presses in the second channel onto the outer side of the base 44 and thereby seals the contact element 2 from sides of the second hole 28. The sealing from sides of the first hole 22 is carried out by placing the cover 34 on the first socket 18, the sealing element 30 pressing onto the outer side of an inner contour 50 of the cover 34 and thereby achieving a water-tight seal.

For secure fixing of the cover 34 on the housing 16, the cover 34 and the housing 16 comprise complementary fastening means in the form of latching tongues 52 on the first socket 18 and clips 54 on the cover 34, the latching tongues 52 being engageable in the clips 54 by rotating the fitted cover 34. The latching is, for example, possible by fitting and engagement in a transverse movement.

As further complementary fastening means, a locking element 56 may be provided on the cover 34 and a corresponding undercut 58 may be provided on the housing 16, which interlock behind one another when the cover 34 is rotated.

The contact element 2 allows secure and leaktight contact of the electrical conductor 4 with the terminal part 40 of the electrical system 42. In particular, the overmoulded housing made of thermoplastic polyurethane leads to a leaktight connection to the conductor insulation 6. The material of the sealing element 30, which is softer than the housing 16, leads to good sealing of the exposed part 17 of the contact part 11 on both sides, particularly in combination with the material of the cover 34 and of the base 44, which is harder than the housing 16. On the other hand, the material of the housing 16 is hard enough to ensure a geometrically stable housing and in particular, to achieve the form-fit securing of the cover 34 on the housing 16 by the latching tongues 52 and the undercut 56.

Figure 3A:
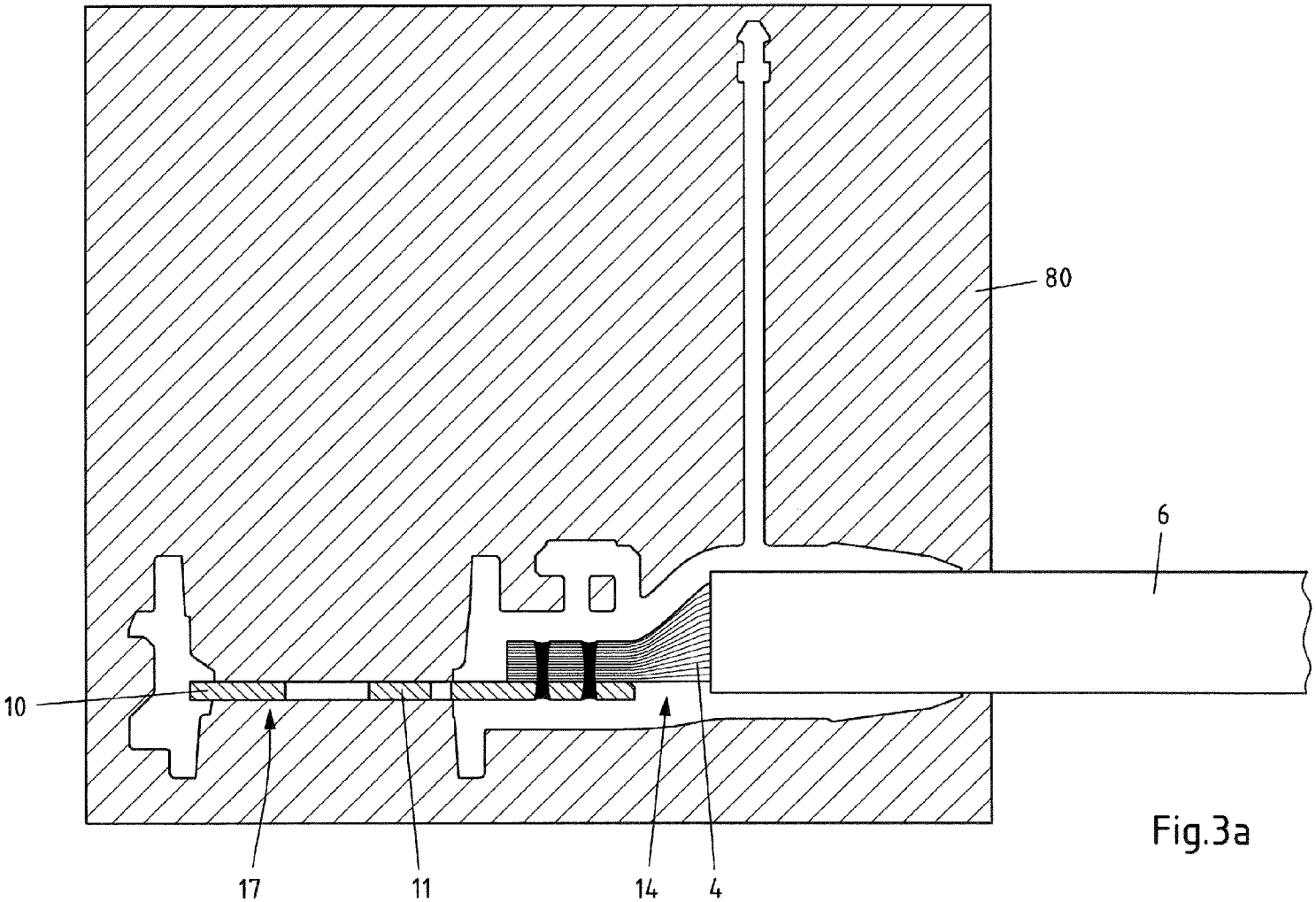
FIG. 3*a-b* show an exemplary embodiment of the method for producing the contact element of FIG. 1*a-b*, and FIG. 4*a-d* show various exemplary embodiments of the cable lug for various exemplary embodiments of the contact element.
Figure 3B:
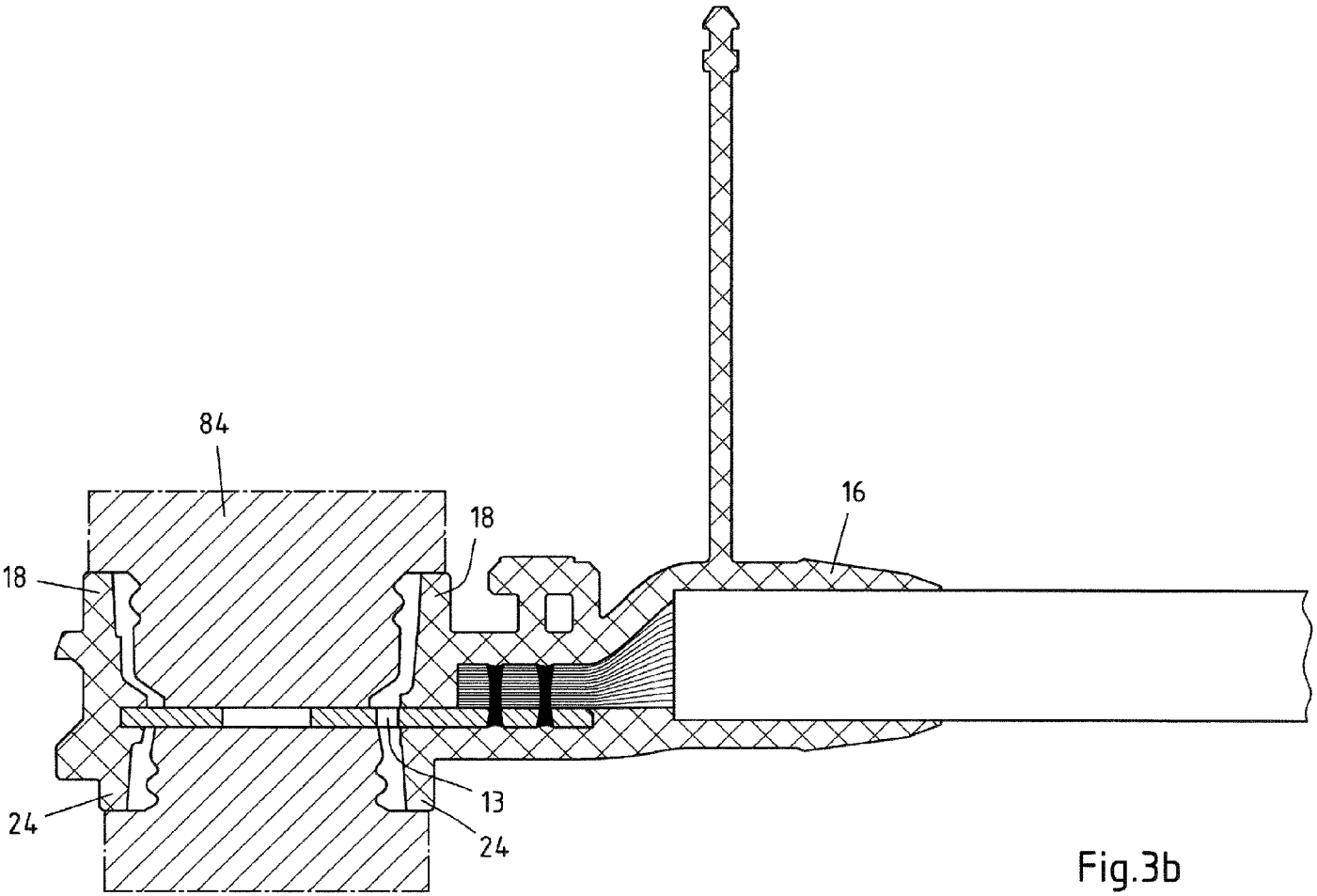

FIGS. 3*a-b* show an exemplary embodiment of the method for producing the contact element 2 of FIG. 1*a* in a schematic representation.

In a first step of the method, the conductor 4 sheathed with the conductor insulation 6 and connected to the cable lug 10 by ultrasound welding is provided, and as shown in FIG. 3*a* is arranged in a first injection mould 80. The first injection-moulding step is then carried out in the injection mould 80, during which the cable lug 10 and the section 14, attached thereto, of the electrical conductor 4 are overmoulded with the housing 16 made of thermoplastic polyurethane, specifically in such manner that the part 17 of the contact part 11 having the bore 12 is exposed, the first and second bases 18, 24 with the channels 20, 26 are produced and the material of the housing 16 is injection-moulded through some of the further openings 13, while other openings of the further openings 13 remain free.

The component produced in this way is subsequently arranged as shown in FIG. 3*b* in a second injection mould 84, in which a second injection-moulding step is then carried out, during which the sealing element 30 is injection-moulded onto the housing 16.

The material injection-moulded in the second injection-moulding step may reach both sides of the contact part 11 through the further openings 13 which previously remained free, without injection-moulding on both sides being necessary. In this way, the production method is simplified.

After the second injection-moulding step, in order to manufacture the contact element represented in FIG. 1*a*, the separately produced cover 34 is connected to the holding element 32.

FIGS. 4*a-d* show various exemplary embodiments of the cable lug for various exemplary embodiments of the contact element.

Figure 4A:
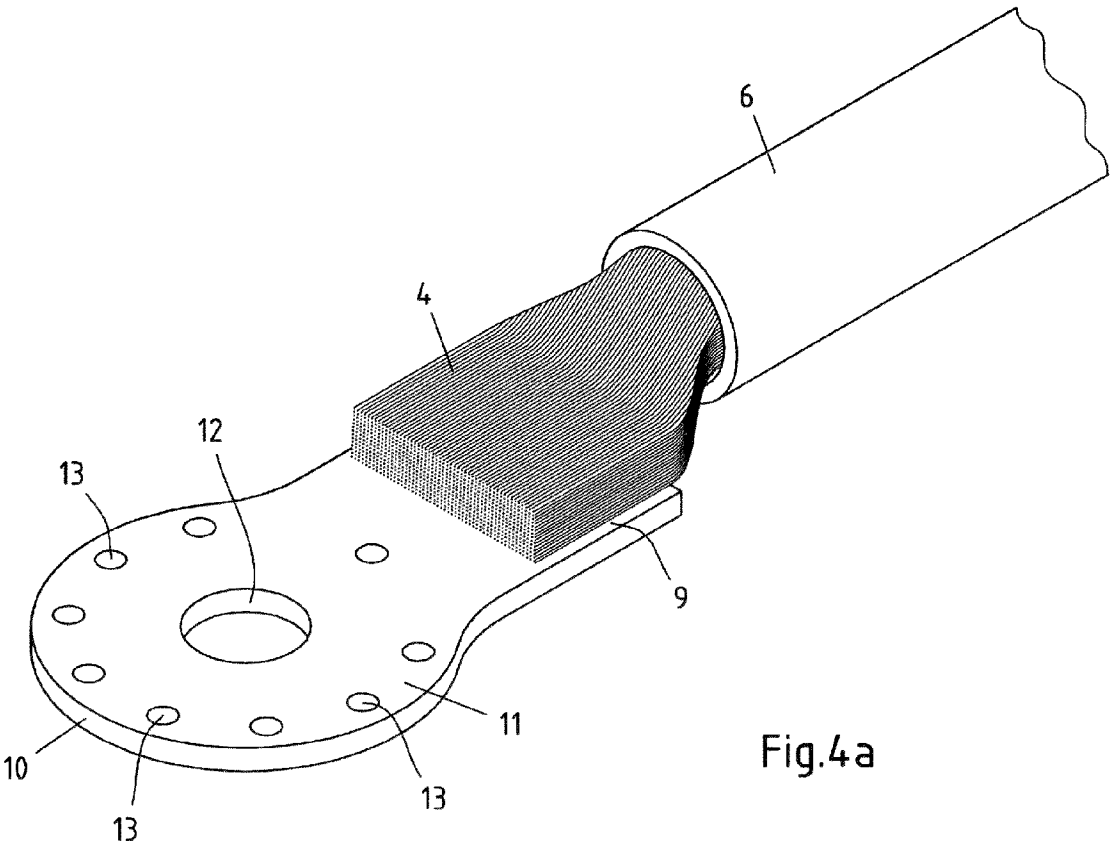

FIG. 4*a* shows the cable lug 10 of the contact element 2 of FIG. 1*a*. The cable lug comprises a flat connection region 9, in which the conductor 4 is welded on, and a flat contact part 11 having the central bore 12 for the threaded bolt 46 and the openings 13 arranged around it for injection-moulding the sealing element 30 through. During the production of the contact element 2, the material of the housing 16 may be injection-moulded through some of the openings 13 in the first injection-moulding step, so that they are filled with the material of the housing 16. In this way, better anchoring of the contact part 11 in the housing 16 may be achieved. Furthermore, as described in connection with FIG. 3*a-b*, some of the openings may remain free during the first injection-moulding step and have the material of the sealing element 30 injection-moulded through them in the second injection-moulding step, so that the production of the contact element 2 is simplified.

Figure 4B:
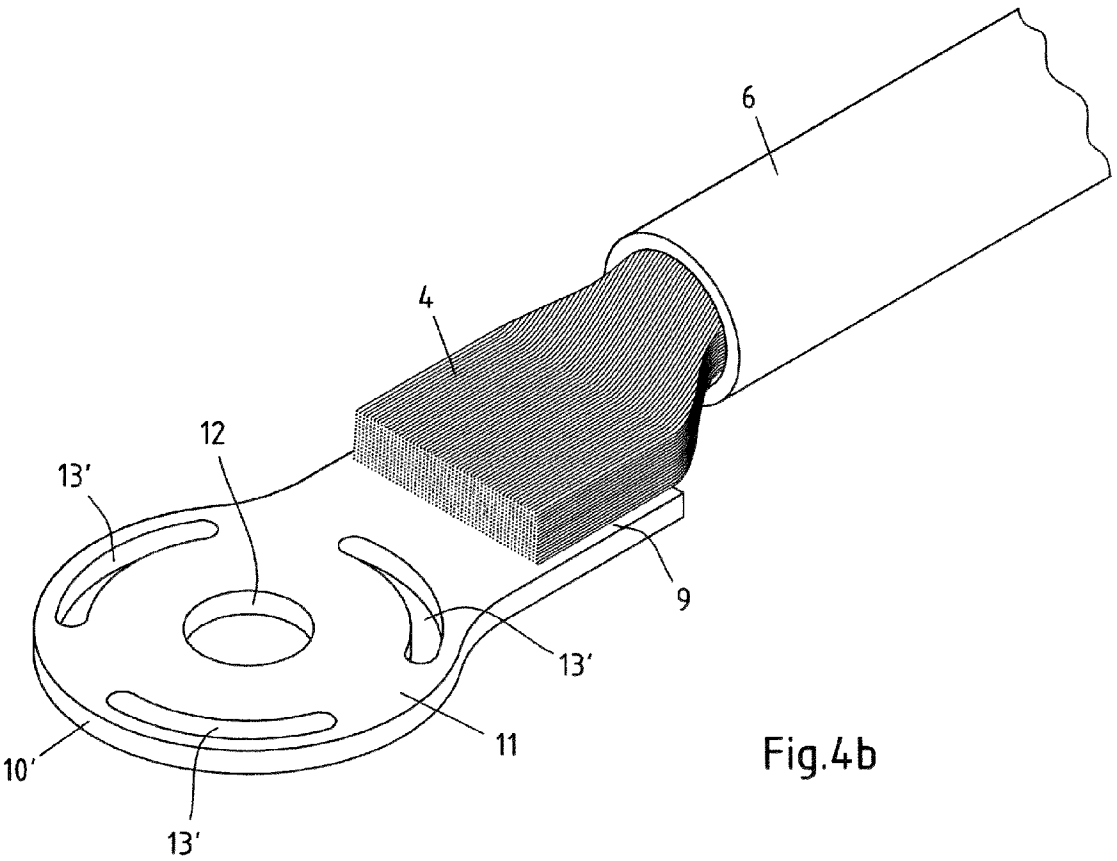

FIG. 4*b* shows an alternative cable lug 10', which differs from the cable lug 10 only by a different shape of the openings 13', which in FIG. 4*b* are configured to be elongate while the openings 13' are configured to be round.

Figure 4C:
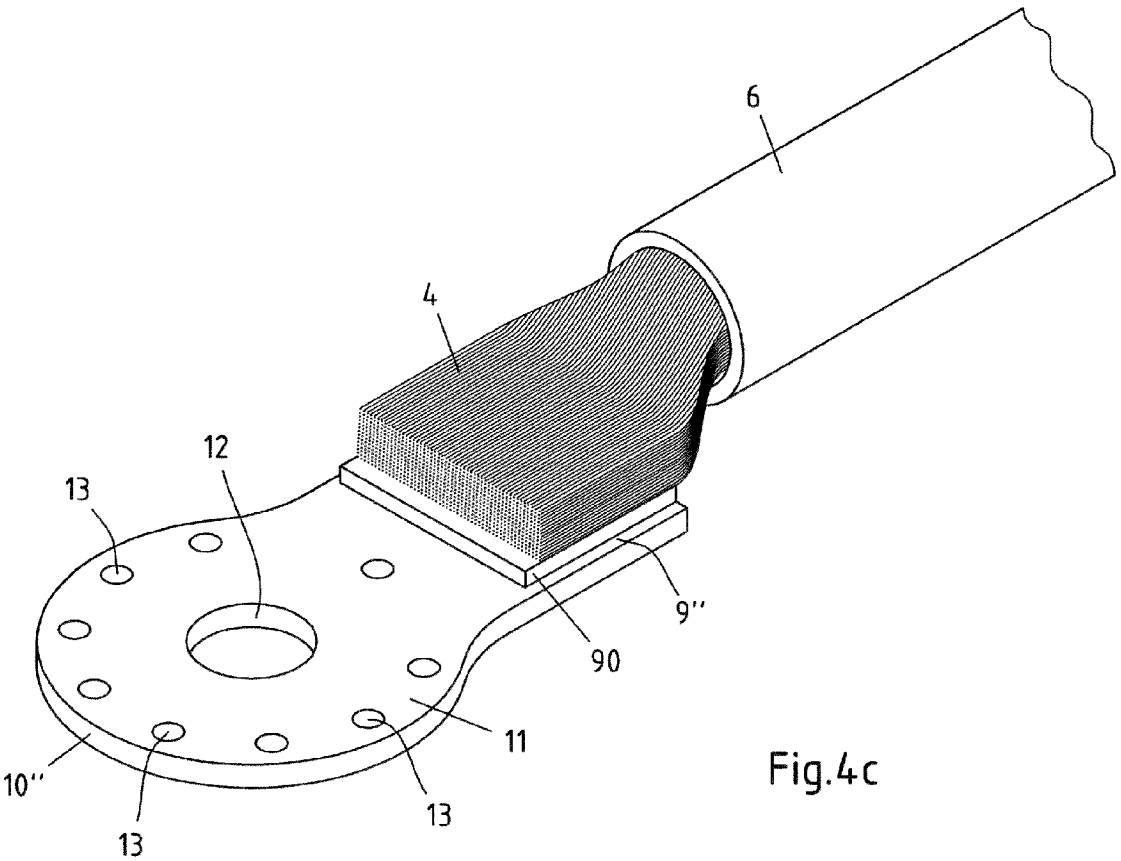

FIG. 4*c* shows a further alternative cable lug 10", which differs from the cable lug 10 only by a contact layer 90 which is applied on the terminal part 9" and improves the weld connection to the conductor 4. The contact layer 90 may, for example, be applied by friction welding.

Figure 4D:
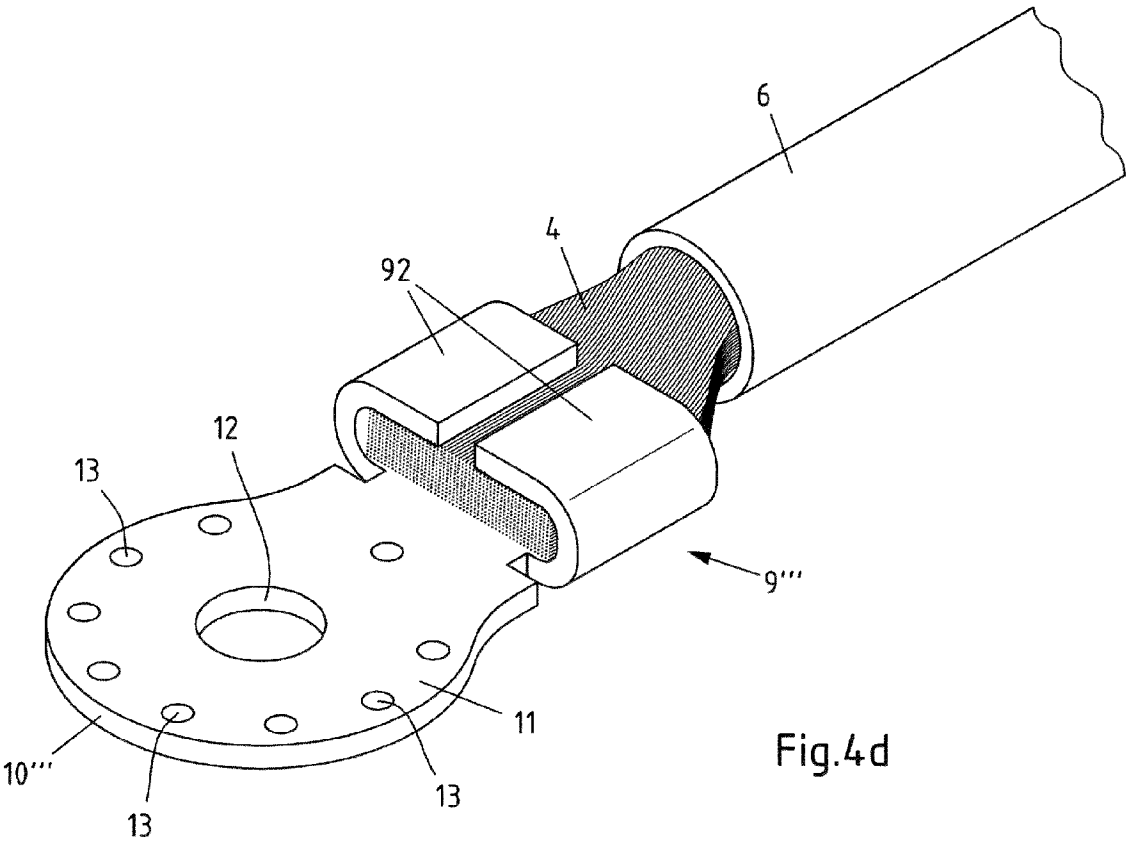

FIG. 4*d* shows a further alternative cable lug 10''', which differs from the cable lug 10 only in that the connection region 9''' is configured for a crimp connection 92. To this end, lateral crimping tabs, which are crimped around the strands of the conductor 4, are provided in the connection region 9'''.

The cable lug 10''' is crimped to the electrical conductor 4 only in the stripped part of the latter. The insulation crimping which is normally conventional for crimp connection is not necessary in the case of a contact element produced with the cable lug 10''', since sufficient stabilisation of the crimping is achieved by the overmoulded housing.

What is claimed is:

1. Contact element for establishing electrical contact of an electrical conductor to a terminal part of an electrical system comprising:

a cable lug, which is conductively connected to the electrical conductor, wherein the cable lug has a connection region for connecting the cable lug to the electrical conductor, wherein the cable lug has a contact part for establishing contact with the terminal part;

wherein the contact part comprises a fastening opening for guiding therethrough a fastening element for fastening the cable lug to the terminal part, and wherein the contact part comprises one or more further openings;

a housing overmoulded by injection moulding onto the cable lug in such manner that a part of the contact part having the fastening opening is exposed, and wherein the housing is injection-moulded at least through one of the one or more further openings of the cable lug; and, an element (30) injection-moulded onto the housing, wherein material of the element (30) injection-moulded onto the housing is injection-moulded through at least one of the one or more further openings of the cable lug.

2. Contact element according to claim 1, wherein the one or more further openings of the cable lug are smaller than the fastening opening at least in one direction.

3. Contact element according to claim 1, wherein the one or more further openings of the cable lug are arranged closer to the edge of the contact part than the fastening opening.

4. Contact element according to claim 1, wherein the one or more further openings of the cable lug comprises a plurality of further openings, which are arranged around the fastening opening.

5. Contact element according to claim 1, wherein the housing comprises a channel which extends from an opening of the housing to the exposed part of the contact part having the fastening opening, and in that the element (30) injection-moulded on is a sealing element for sealing a closure, in particular a cover, usable for closing the opening.

6. Method for producing a contact element comprising:

providing a cable lug, wherein the cable lug has a connection region for connecting the cable lug to an electrical conductor, wherein the cable lug has a contact part for establishing contact with a terminal part of an electrical system, wherein the contact part comprises a fastening opening for guiding therethrough a fastening element for fastening the cable lug to a terminal part, and wherein the contact part comprises one or more further openings;

injection-moulding through at least one of the one or more further openings of the contact part so as to overmould a housing onto the cable lug, such that a part of the contact part having the fastening opening is exposed; and injection-molding an element (30) on the housing, wherein at least one of the one or more further openings of the cable lug are injected-molded through with the material of the element (30).

7. Method according to claim 6, wherein at least one of the one or more further openings of the cable lug remains free during the production of the housing, and in that the element (30) connected to the housing is produced by injection-moulding onto the housing, the material of the element being injection-moulded through the at least one opening which remained free during the production of the housing.

* * * * *